United States Patent [19]

Tsuzuki

[11] Patent Number: 4,529,162

[45] Date of Patent: Jul. 16, 1985

[54] CONCRETE SEGMENT MOLDING FLASK

[76] Inventor: Junichi Tsuzuki, 6-30-8, Seijo, Setagaya-Ku, Tokyo, Japan

[21] Appl. No.: 543,466

[22] Filed: Oct. 19, 1983

[30] Foreign Application Priority Data

Nov. 9, 1982 [JP] Japan ..... 57-196620

[51] Int. Cl.[3] ..... B28B 7/04

[52] U.S. Cl. ..... 249/158; 249/167

[58] Field of Search ..... 249/154, 155, 157, 158, 249/163, 166, 167

[56] References Cited

U.S. PATENT DOCUMENTS

| | | | |
|---|---|---|---|
| 788,481 | 4/1905 | Lightner | 249/158 X |
| 799,493 | 9/1905 | Pfeiffer | 249/158 |
| 896,330 | 8/1908 | Scheelky | 249/158 X |
| 3,964,727 | 6/1976 | Gladwin | 249/158 |

FOREIGN PATENT DOCUMENTS

| | | | |
|---|---|---|---|
| 43-11798 | 5/1968 | Japan | 249/154 |
| 330632 | 6/1930 | United Kingdom . | |
| 675394 | 7/1952 | United Kingdom . | |
| 1540244 | 2/1979 | United Kingdom | 249/154 |

*Primary Examiner*—J. Howard Flint, Jr.

*Attorney, Agent, or Firm*—Body, Vickers & Daniels

[57] ABSTRACT

Conventional concrete segment molding flasks are constituted from separate bottom molding flasks and side molding flasks. Since the concrete segment molding flasks are respectively assembled with connecting bolts, and the bottom and side molding flasks are usually formed of steel material so that they are too heavy to manually handle with ease, it is extremely troublesome to assemble, disassemble and locate the molding flasks. This invention proposes to resolve said prior problems and aims to provide a concrete segment molding flask which can be easily assembled, disassembled and located as the bottom and side molding flasks are interconnected.

4 Claims, 4 Drawing Figures

CONCRETE SEGMENT MOLDING FLASK

BACKGROUND OF THE INVENTION

1. Field of the Invention:

This invention relates to a concrete segment molding flask.

2. Description of the Prior Art:

Conventional concrete segment molding flask are constituted from separate bottom molding flasks and side molding flasks. Since the concrete segment molding flasks are respectively assembled with connecting bolts, and the bottom and side molding flasks are usually formed of steel material so that they are too heavy to manually handle with ease, it is extremely troublesome to assemble, disassemble and locate the molding flasks.

OBJECT OF THE INVENTION

The present invention proposes to resolve said prior problems and aims to provide a concrete segment molding flask which can be easily assembled, disassembled and located when the concrete segment is molded.

Figure 1:
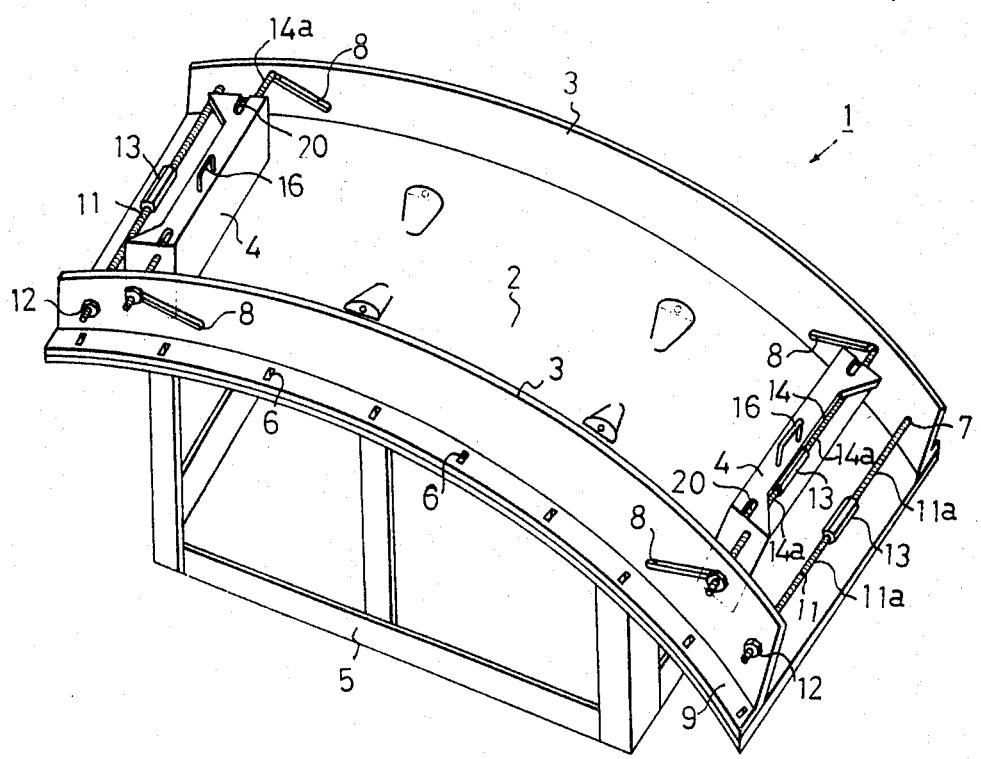
FIGS. 1 and 2 are respectively perspective views showing a concrete segment molding flask being disassembled and assembled.
Figure 2:
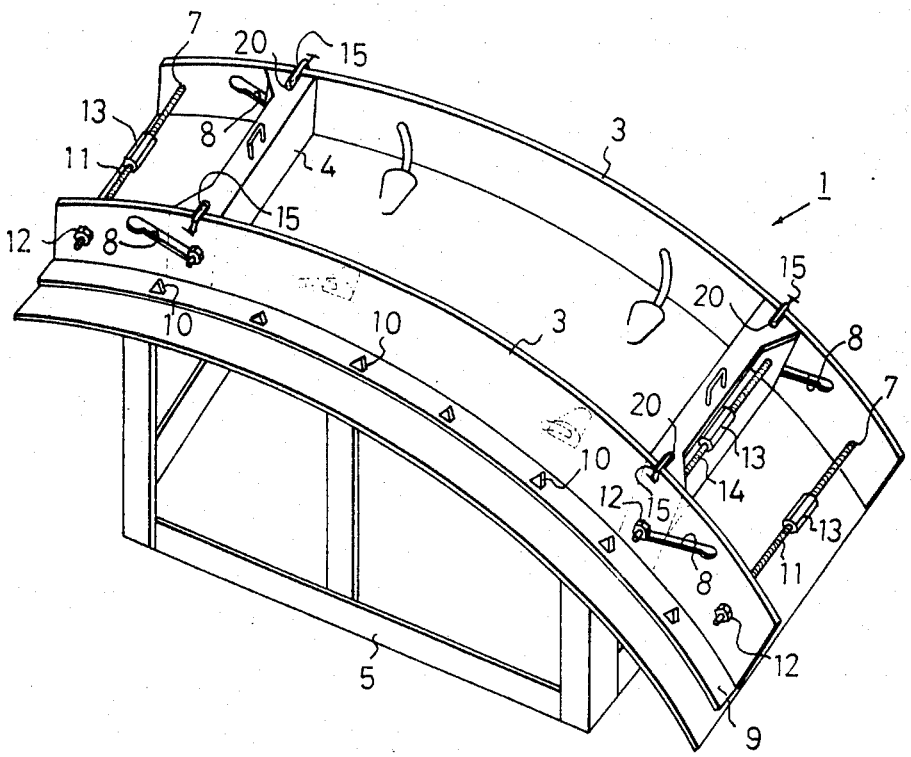
Figure 3:
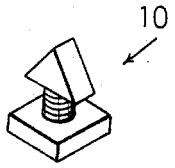
FIGS. 3 and 4 are respectively a perspective view and side view showing a stud and fastener.
Figure 4:
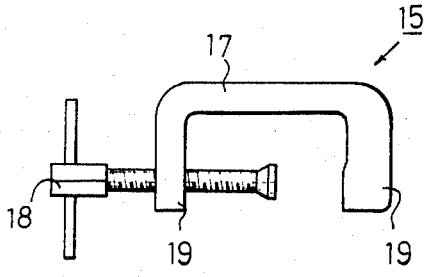

1 . . . Concrete segment molding flask;
2 . . . Bottom molding flask;
3 . . . Widthwise end side molding flask;
4 . . . Circumferential end side molding flask;
5 . . . Bed;
. . . Stop hole;
7, 8 . . . Bolt inserted hole;
9 . . . Mounting rib;
10 . . . Stud;
11 . . . Connecting bolt;
**11*a*** . . . Bolt;
12 . . . Lock nut;
13 . . . Connector;
14 . . . Mounting bolt;
**14*a*** . . . Bolt;
15 . . . Fastener
16 . . . Handle;
17 . . . Fastener body;
18 . . . Fastening bolt;
19 . . . Leg;
20 . . . Hole

DETAILED DESCRIPTION OF PREFERRED EMBODIMENT OF THE INVENTION

Hereinafter will be described the present invention with reference to an embodiment shown in the drawings. A concrete segment molding flask 1 is constituted from a bottom molding flask 2, widthwise end side molding flasks 3, 3 and circumferential end side molding flasks 4, 4, and placed on a bed 5.

The bottom molding flask 2 is formed of a rectangular plate curved with a predetermined curvature. Stop holes 6, 6 elongated widthwise of the bottom molding flask 2 are formed somewhat inside both widthwise edges of said flask 2 circumferentially at predetermined intervals.

The widthwise end side molding flasks 3, 3 are formed of rectangular plate curved with a curvature conforming to that of the bottom molding flask 2. In both longitudinal ends of the widthwise end side molding flasks 3, 3 are formed bolt inserted holes 7, 7, inside which are formed respectively bolt inserted slots 8, 8. Also, the widthwise end side molding flasks 3, 3 are formed on the lower edges with mounting ribs 9, 9 projecting outward approximately perpendicular thereto and continuously longitudinally of said flasks 3, 3, and stop holes 6, 6 elongated widthwise of said ribs 9, 9 are formed longitudinally of these mounting ribs 9, 9 at predetermined intervals. The widthwise end side molding flasks 3, 3 thus formed are placed on both widthwise ends of the bottom molding flasks 2 and secured fixedly to the bottom molding flask 2 by inserting studs 10, 10 in the stop holes 6, 6 of the bottom molding flask 2 and the stop holes 6, 6 of the mounting ribs 9, 9 when the molding flask is assembled.

The studs 10, 10 are inserted from the stop holes 6, 6 of the bottom molding flask 2 into the stop holes 6, 6 of the mounting ribs 9, 9 and fixed by $\frac{1}{4}$ rotation in the stop holes 6, 6. Also, between the left and right widthwise end side molding flasks 3, 3 are provided connecting bolts 11, 11 both ends of which extend through the left and right bolt inserted holes 7, 7, and lock nuts 12, 12 are screwed onto the portions of the connecting bolts 11, 11 extending through said holes 7, 7.

The connecting bolts 11, 11 are formed of bolts **11*a*, 11*a* which are threaded reversely to each other and interconnected with a connector 13 such as long nut, and have the length freely adjusted by rotating the connector 13. When the molding flask is assembled, the connector 13 is tightened so as to shorten the connecting bolts 11, 11 for inter connecting firmly the left and right widthwise end side molding flasks 3, 3. Also, when the molding flask is disassembled, the connector 13 is loosened to lengthen the connecting bolts 11, 11 for expanding outward the left and right widthwise end side molding flasks 3, 3**.

Circumferential end side molding flasks 4, 4 are generally box-shaped and open sideways. The flasks 4, 4 are provided between the left and right widthwise end side molding flasks 3, 3 on both circumferential ends of the bottom molding frame 2 and fixed thereto with mounting bolts 14, 14.

The mounting bolts 14, 14 are formed of bolts **14*a*, 14*a* threaded reversely to each other and interconnected with connectors 13, 13 and have the length freely adjusted by rotating the connector 13. And said mounting bolts 14, 14 have both ends extended through the bolt inserted holes 8, 8 of the left and right widthwise end side molding flasks 3, 3 while being mounted thereon by screwing lock nuts 12, 12 onto the both ends extended through the holes 8, 8. When the molding flask is assembled, the mounting bolts 14, 14 are moved to the inside ends of the bolt inserted holes 8, 8 to provide circumferential end side molding flasks 4, 4 inside the molding flask and connectors 13, 13 are tightened to shorten the mounting bolts 14, 14 so that the circumferential end side molding flasks 4, 4 are fixed between the left and right widthwise end side molding flasks 3, 3. On the other hand, when the molding flask is disassembled, the connectors 13, 13 are loosened to lengthen the mounting bolts 14, 14 and then the mounting bolts 14, 14 are moved to the outside ends of the bolt inserted holes 8, 8 to move the circumferential end side molding flasks 4, 4 to the outside of the molding flask. Further, the outside ends of the bolt inserted holes 8, 8 are formed with large holes which engage temporarily the loosened mounting bolts 14, 14**.

Reference numerals 15, 15 in the drawing designate fasteners for fastening the upper ends of the widthwise end side molding flask 3 and circumferential end side molding flask 4 when the molding flask is assembled, and are constituted from a generally U-shaped fastener body 17 and fastening bolt 18. And when the fasteners 15, 15 are mounted, one leg 19 of the fastener body 17 is inserted into a hole 20 provided in an end of the circumferential end side molding flask 4, the opposite leg 19 of said fastening body 15 engages the circumferential end side molding flask 4 and then the fastening bolt 18 is tightened. Reference numerals 16, 16 designate handles of the circumferential end side molding flasks 4, 4.

This invention thus constituted provides extremely high operability since the bottom molding flask, widthwise end side and circumferential end side molding flasks are not needed to move from the installing position of the molding flask to the other position when the molding flask is assembled and disassembled.

Also, the dimensional accuracy of formed concrete segment can be improved since the widthwise end side molding flasks and circumferential end side molding flasks are mounted to move widthwise and circumferentially of the bottom molding flask within a predetermined range.

What is claimed is:

1. In a concrete segment molding flask having, a bottom portion with a generally planar upper surface and a predetermined curvature along the length thereof; a pair of side members extending generally along the lateral edge of said bottom portion in opposed relation to each other, said side members having a curvature generally conforming to that of said bottom portion; and a pair of end members on the lengthwise edge of said bottom portion in opposed relation to each other, the improvement comprising: means for interconnecting said bottom portion and said side members and said end members to form an assembly wherein said side members and said end members are movable along said upper surface between an assembled configuration and a disassembled configuration wherein said assembly remains unitary, said means including means for mounting said side members on the lateral edges of said bottom portion such that each of said side portions is laterally movable within a predetermined distance unitarily to said bottom portion, and means for mounting said end members to said assembly such that each of said end members is movable lengthwise along said upper surface within a predetermined distance unitarily to said assembly.

2. A concrete segment molding flask as defined in claim 1, wherein said end portions are mounted to said side members such that said end members are movable lengthwise along said upper surface within a predetermined distance.

3. A concrete segment molding flask as defined in claim 2, wherein pins on said end member extend through slots in said side members to mount said end members thereto.

4. A concrete segment molding flask as defined in claim 1, wherein said means for mounting said side members on the lateral edges of said bottom portion includes a plurality of elongated slots in said side members in register with similar slots in said base portion, and fastening means extend therethrough.

* * * * *